US008955170B2

(12) United States Patent
Chiang

(10) Patent No.: US 8,955,170 B2
(45) Date of Patent: Feb. 17, 2015

(54) SWIMMING GOGGLES

(71) Applicant: Global Esprit Inc., New Taipei (TW)

(72) Inventor: Herman Chiang, New Taipei (TW)

(73) Assignee: Global Esprit Inc., New Taipei (TW)

( * ) Notice: Subject to any disclaimer, the term of this patent is extended or adjusted under 35 U.S.C. 154(b) by 0 days.

(21) Appl. No.: 13/936,111

(22) Filed: Jul. 5, 2013

(65) Prior Publication Data

US 2014/0331395 A1 Nov. 13, 2014

(30) Foreign Application Priority Data

May 9, 2013 (TW) ..... 102208626 U

(51) Int. Cl.
*A61F 9/02* (2006.01)
*A63B 33/00* (2006.01)

(52) U.S. Cl.
CPC ..... *A63B 33/002* (2013.01)
USPC ..... 2/440

(58) Field of Classification Search
USPC ..... 2/442, 426, 427, 428, 431, 439, 440, 2/452
See application file for complete search history.

(56) References Cited

U.S. PATENT DOCUMENTS

| | | | | |
|---|---|---|---|---|
| 5,706,527 | A * | 1/1998 | Kita et al. | 2/452 |
| 6,023,791 | A * | 2/2000 | Chiang | 2/441 |
| 6,112,334 | A * | 9/2000 | Chiang | 2/428 |
| 6,513,170 | B1 * | 2/2003 | Chiang | 2/428 |
| 7,007,310 | B2 * | 3/2006 | Chiang | 2/446 |
| 7,159,250 | B2 * | 1/2007 | Chiang | 2/428 |

* cited by examiner

*Primary Examiner* — Tejash Patel
(74) *Attorney, Agent, or Firm* — Cheng-Ju Chiang

(57) ABSTRACT

Swimming goggles include left and right frame bodies installed with lenses, a connecting element, and protective pads and head strap bases respectively disposed on the left and right frame bodies. The left and right frame bodies each of which has an inner peripheral face and an outer peripheral face, and the protective pads each has a face contact portion and a connecting portion. Contours of the outer peripheral faces of the left and right frame bodies and the face contact portions are fit to face portions with respect to inner peripheries of eye sockets of a cranium of a wearer. Upper and lower edges of the face contact portions with respect to lower sides of eyebrows and lower sides of under-eye bags remain gaps with the connecting portions in a manner that the upper and lower edges of the face contact portions are nearly in contact with the connecting portions.

13 Claims, 10 Drawing Sheets

SWIMMING GOGGLES

BACKGROUND OF THE INVENTION

1. Field of the Invention

The present invention relates to swimming goggles, and particularly to swimming goggles capable of being worn comfortably and ergonomically without water leakage, reducing water resistance in swimming, and providing a better range of visual field.

2. Related Art

Conventional racing swimming goggles are designed to fit for a contact portion corresponding to inner peripheries of each eye socket of the cranium at a wearer's face. As shown in FIG. 11, more specific, the contact portion is defined to correspond to an upper inner periphery 60 of an eye socket 6 below an eyebrow 70, a lower side 71 of an under-eye bag with respect to a lower inner periphery 61 of the eye socket 6, a side portion 82 of a nose bridge 8 adjacent to lacrimal gland 72 with respect to an inner periphery 62 of the eye socket 6, and an outer eye corner 73 with respect to an inner periphery 63 of the eye socket 6 adjacent to the temple. With the above-mentioned structure, the water resistance to the swimming goggles is therefore being reduced to a minimum in swimming. Conventional racing swimming goggles are made of a hard material to integrally form lenses and a frame together, wherein the frame is not provided with a protective pad to contact a wearer's face. As a result, the wearer has to bear the uncomfortable feeling of directly contacting the hard material made frame, and the problem of water leakage into the swimming goggles may arise because of incomplete attachment to the face. Accordingly, another type of conventional racing swimming goggles is provided with a protective pad on sides of a frame to contact the face so as to overcome the problems of causing uncomfortable wearing feeling and water leakage. However, the protective pad has a shape of an inverted J in cross section, and the J-shaped protective pad is attached to an area formed by eyebrows and the zygomatic bone in a frontward direction; that is to say, the J-shaped protective pad is not attached to the aforementioned contact portion and thus causes the frame to stick out of the forehead, as seen from a side view, and increases water resistance to a swimmer when swimming forward. Furthermore, because the frame is over the forehead, and lenses of conventional swimming goggles are inclined with respect to wearer's eyes after being worn, the field of vision at corners of a wearer's eyes are being blocked by the frame.

SUMMARY OF THE INVENTION

Accordingly, an object of the present invention is to provide swimming goggles for racing and fitting to face portions with respect to inner peripheries of eye sockets of a cranium of a wearer so as to be worn comfortably without water leakage and to reduce water resistance in swimming.

Another object of the present invention is to provide swimming goggles capable of preventing a range of visual field from being blocked by goggle frames so as to provide a better and wider range of visual field in swimming.

To achieve the above-mentioned objects, the swimming goggles comprises a left frame body and a right frame body each having an inner peripheral face and an outer peripheral face and being installed with lenses; a connecting element interconnecting the left and right frame bodies; protective pads respectively attached to the inner peripheral faces of the left and right frame bodies; and head strap bases respectively disposed on outer sides of the left and right frame bodies.

Each of the protective pads having a face contact portion and a connecting portion, wherein contours of the outer peripheral faces of the left and right frame bodies and the face contact portions are fit to face portions with respect to inner peripheries of eye sockets of a cranium of a wearer, each of the face portions being defined to correspond to an upper inner periphery of the eye socket below an eyebrow, a lower side of an under-eye bag with respect to a lower inner periphery of the eye socket, a side portion of a nose bridge adjacent to lacrimal gland, and an outer eye corner with respect to an inner periphery of the eye socket adjacent to a temple. A hook channel extends from and along the inner peripheral face of each of the left and right frame bodies. The connecting portion of each protective pad integrally encompasses the hook channel. Upper and lower edges of each of the face contact portions a lower side of the eyebrow and a lower side of the under-eye bag remain a gap with the connecting portion in a manner that the upper and lower edges of the face contact portion are nearly in contact with the connecting portion; whereby the left and right frame bodies being capable of fitting onto the face portions with respect to the inner peripheries of the eye sockets of the cranium.

According to one aspect of the present invention, the lenses are respectively integrally formed with the outer peripheral faces of the left and right frame bodies. Each of the lenses has a fold line to define the lens into a first inclined face and a second inclined face. The configuration of first inclined face prevents a range of visual field from being blocked by the first and second frame bodies so as to provide a better and wider range of visual field in swimming.

According to another aspect of the present invention, a thickness of each of the left and right frame bodies in vertical cross section adjacent to the eyebrow is less than a thickness of each of the left and right frame bodies adjacent to the lower side of the under-eye bag, whereby to enable each of the left and right frame bodies to be perfectly fit to contours of a lower side of the eyebrow and the lower side of the under-eye bag, and to enable the first inclined faces of the lenses to be substantially parallel with the eyes of the wearer.

DESCRIPTION OF THE PREFERRED EMBODIMENTS

Figure 5:
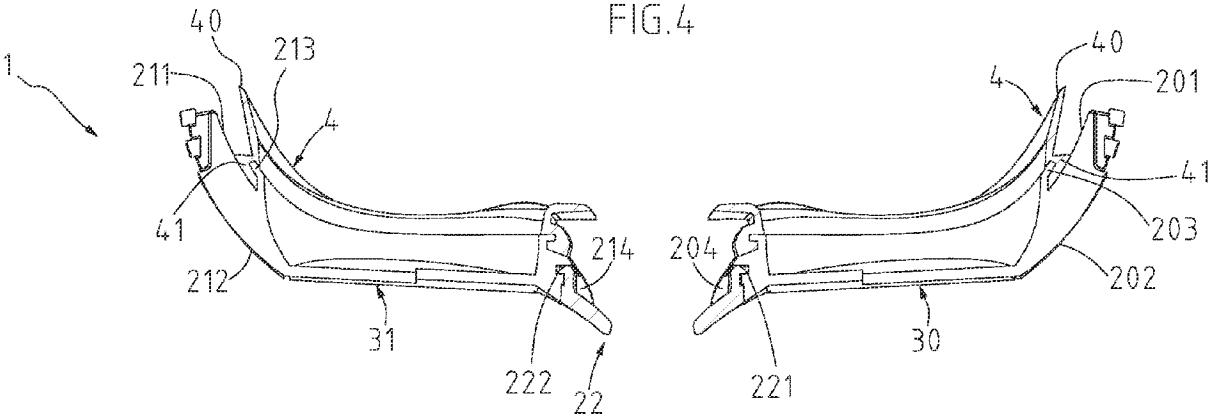
FIGS. 5 to 7 are cross-sectional views respectively taken along lines 5-5, 6-6 and 7-7 of FIG. 4.
Figure 7:
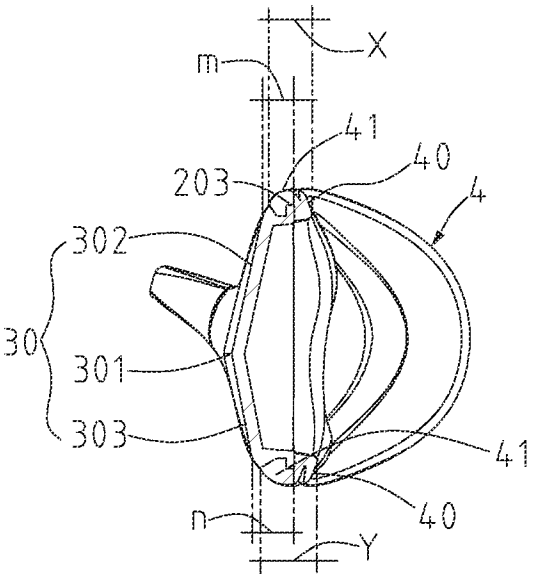

Referring to FIGS. 1 to 7, swimming goggles 1 of the present invention comprise a left frame body 20, a right frame body 21, a connecting element 22, lenses 30 and 31 received in the left and right frame bodies 20 an 21, protective pads 4, and head strap bases 5. The left and right frame bodies 20 and 21 are made of polycarbonate resin and respectively have inner peripheral faces 201 and 211 and outer peripheral faces 202 and 212, wherein the inner peripheral faces 201 and 211 are integrally formed with hook channels 203 and 213 (as shown in FIGS. 5 and 7) for facilitating a grab for a plastic material as plastic injection molding. The hook channels 203 and 213 respectively extend rearward from and along the inner peripheral faces 201 and 211 to form a substantially L shape in cross section. Each of the hook channels 203 and 213 has a rear face opposite to the outer peripheral faces 202 and 212. Contours of the outer peripheral faces 202 and 212 of the left and right frame bodies 20 and 21 are fit to face portions with respect to inner peripheries of eye sockets of a cranium of a wearer. More specific, each of the face portions is defined to correspond to an upper inner periphery of the eye socket below an eyebrow, a lower side of an under-eye bag with respect to a lower inner periphery of the eye socket, a side portion of a nose bridge adjacent to lacrimal gland, and an outer eye corner with respect to an inner periphery of the eye socket adjacent to a temple. In this manner, after wearing, upper and lower edges of the outer peripheral faces 202 and 212 of the left and right frame bodies 20 and 21 are positioned to correspond to the inner peripheries of the eye sockets of the cranium. Furthermore, in vertical cross section each of the left and right frame bodies 20 and 21 has a thickness m with respect to the eyebrow and a thickness n with respect to the lower side of the under-eye bag, wherein the thickness m is different than the thickness n (as shown in FIG. 7). The thicknesses m and n are respectively defined to be measured from the inner peripheral faces 201 and 211 to surfaces of the lenses 30 and 31. In this embodiment, regarding the left frame body 20, the thickness m at an upper edge thereof is measured from the rear face of the hook channel 203 to the surface of the lens 30 and is less than the thickness n at a lower edge of the left frame body 20 measured from a rear face of the hook channel 203 to the surface of the lens 30. Likewise, the thicknesses m and n of the right frame body 21 are measured in the same manner as described above. The configuration of different thickness m and n enable the left and right frame bodies 20 and 21 to be perfectly fit to contours of the lower sides of the eyebrows and the lower sides of the under-eye bags. Additionally, each of the left and right frame bodies 20 and 21 has an arc surface 205 (215) formed between the lacrimal gland and the side portion of the nose bridge so as to allow the left and right frame bodies 20 and 21 to be perfectly attached to contours of the side portions of the nose bridge.

The lenses 30 and 31 are made of polycarbonate resin and are respectively formed with the out peripheral faces 202 and 212 of the left and right frame bodies 20 and 21. The lenses 30 and 31 respectively have fold lines 301 and 311 to define the lenses 30 and 31 into first inclined faces 302 and 312 and second inclined faces 303 and 313. The first inclined faces 302 and 312 are disposed above and incline inward from the fold lines 301 and 311. The second inclined faces 303 and 313 are disposed below and incline inward from the fold lines 301 and 311. The first inclined faces 302 and 312 ensure that a range of visual field is not blocked by the left and right frame bodies in swimming and therefore provides a better view in swimming The connecting element 22 is being arc and has engaging pegs 221 and 222 at opposite ends thereof (as shown in FIG. 5). The outer peripheral faces 202 and 212 of the left and right frame bodies 20 and 21 corresponding to the engaging pegs 221 and 222 are extended to form engaging seats 204 and 214 for being engaged with the engaging pegs 221 and 222, and the engaging seats 204 and 212 are located above the fold lines 301 and 311 of the lenses 30 and 31 (referring to FIG. 4). Alternatively, the connecting element 22 is capable of having different shape based on practical designs in order for varied contours of nose bridges.

The protective pads 4 are respectively attached to the inner peripheral faces 201 and 211 of the left and right frame bodies 20 and 21. Each of the protective pads 4 has a face contact portion 40 and a connecting portion 41 both made of thermal plastic rubber (TPR) for providing a comfortable contact in wearing. The protective pads 4 are integrally formed with the left and right frame bodies 20 and 21 through the connection between the connecting portions 41 and the hook channels 203 and 213 (referring to FIG. 7). Moreover, Contours of the face contact portions 40 of the protective pads 4 are fit to the face portions with respect to the inner peripheries of the eye sockets of the cranium, wherein the upper and lower edges of the face contact portion 40 are adjacent to and nearly in contact with the connecting portions 41 with a gap t formed therebetween (referring to FIGS. 1A and FIGS. 2 and 3). In this manner, after wearing, the upper and lower edges of the face contact portions 40 are positioned to correspond to the lower sides of the eyebrows and the lower sides of the under-eye bags so as to allow the left and right frame bodies 20 and 21 as a whole to be perfectly attached to the face portions with respect to the contours of the inner peripheries of the eye sockets of the cranium, whereby the first inclined faces 302 and 312 of the lenses 30 and 31 are being substantially parallel with the eyes of the wearer. Particularly, in vertical cross section the protective pads 4 have thicknesses x and y with respect to the upper and lower edges of the left and right frame bodies 20 and 21 (referring to FIG. 7). More specific, in respect of the protective pad 4 of the left frame body 20, the thickness x with respect to the upper edge of the left frame body 20 is less than the thickness y with respect to the lower edge of the left frame body 20, and vice versa as the thickness x and y of the protective pad 4 of the right frame body 21. As a result, the swimming goggles 1 is capable of being perfectly fit to the contours of the lower sides of the eyebrows and the lower sides of the under-eye bags.

Figure 1A:
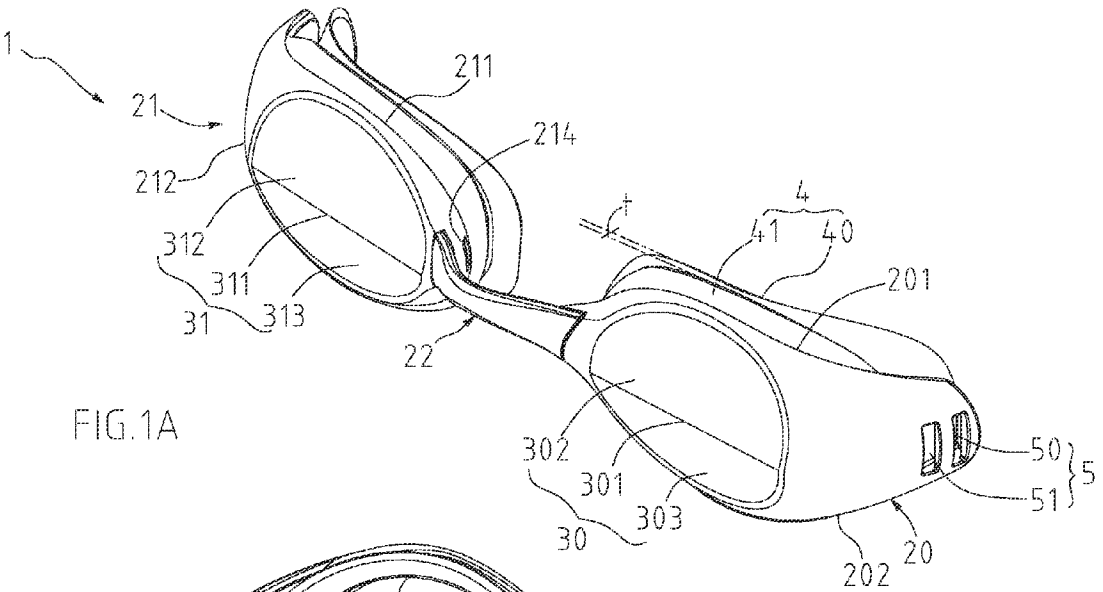
FIGS. 1A and 1B are respectively a front, right perspective view and a rear, left perspective view of a first embodiment of swimming goggles of the present invention respectively.
Figure 1B:
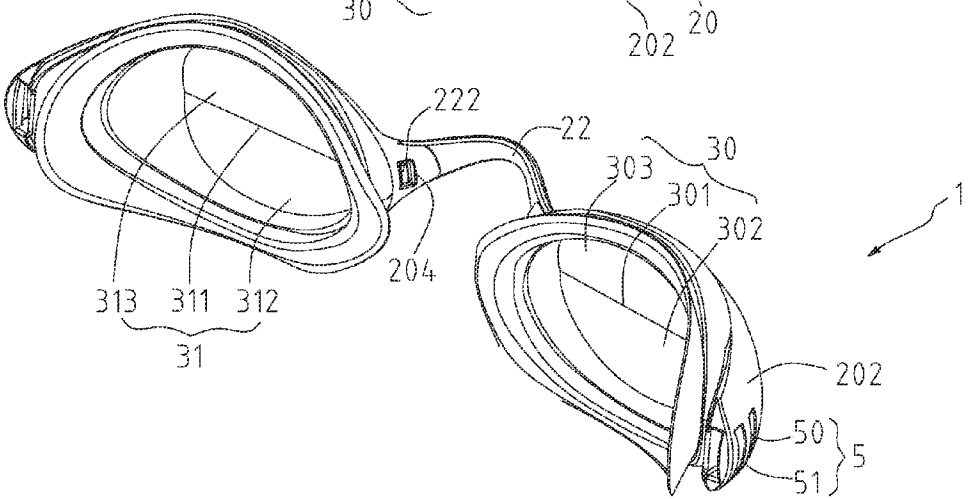
Figure 2:
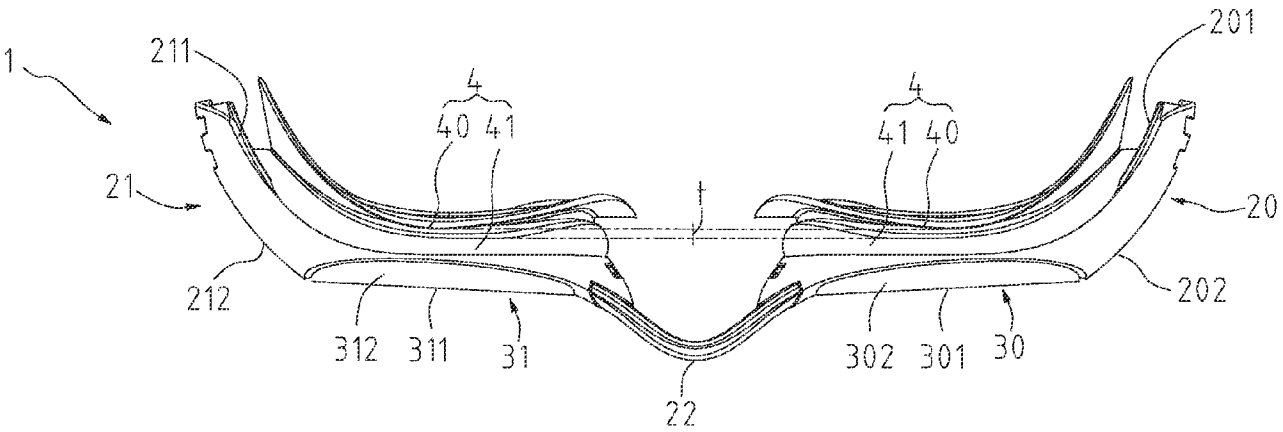
FIGS. 2 and 3 are respectively a top plan view and a bottom plan view of FIG. 1A.
Figure 3:
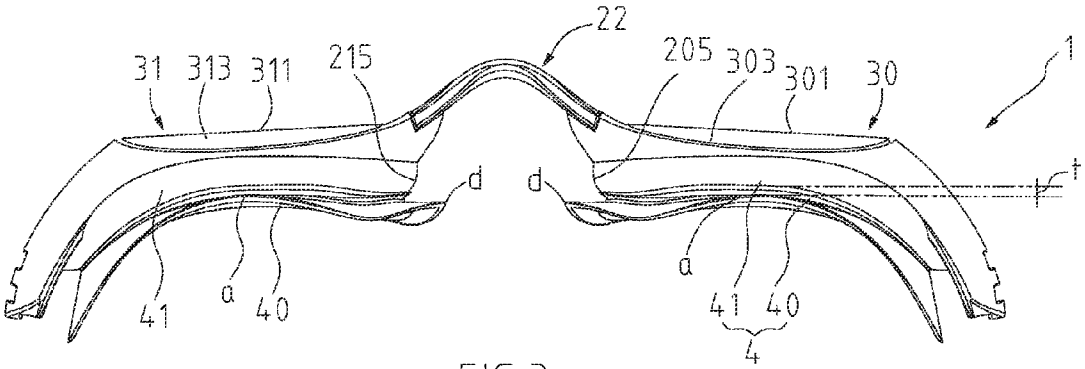
Figure 4:
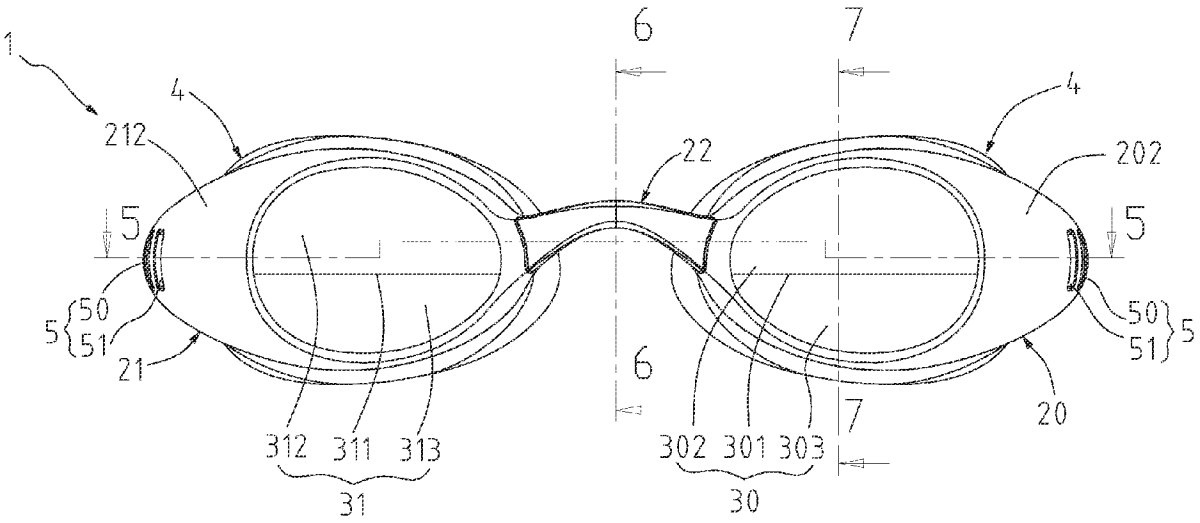
FIG. 4 is a front elevational view of FIG. 1A.
Figure 6:
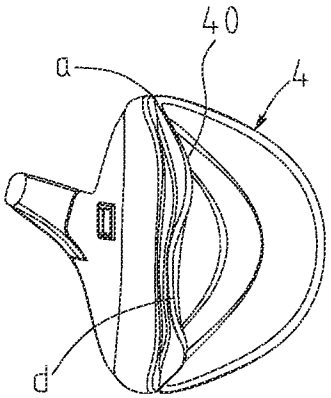

It is particularly noted that as the swimming goggles 1 of the present invention is viewed from a top angle or a side angle as shown in FIGS. 3 and 6, the face contact portions 40 of the protective pads 4 are respectively in a continuous curved shape; that is, in corresponding to the contours of the lower side of the eyebrow and the lower side of the under-eye bag, the face contact portion 40 is nearly in contact with the connecting portion 41 with a gap remained therebetween and thus a first recess a in a curved shape is being formed. A second recess d in a curved shape is formed with respect to the arc surface 205 (215) of the left (right) frame body 20 (21), whereby the first recess a and the second recess d enable the swimming goggles 1 to be ergonomic to the face portions with respect to the inner peripheries of the eye sockets of the cranium.

Figure 8A:
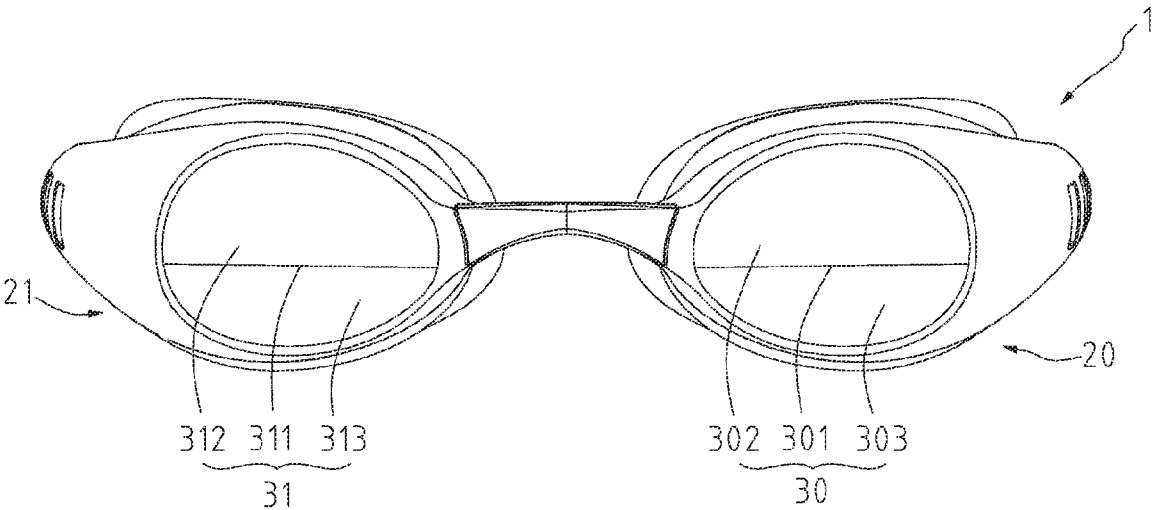
FIGS. 8A, 8B, 8C, 8D and 8E are respectively a front elevational view, a top plan view, a side elevational view, and a bottom plan view schematically simulatedly showing positions where the swimming goggles are in a state of being worn on a wearer.
Figure 8B:
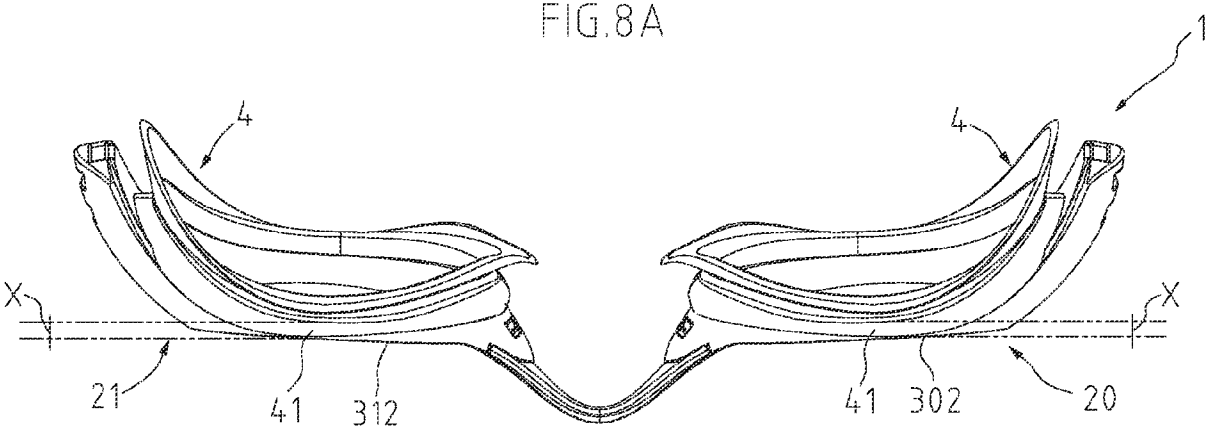
Figure 8C:
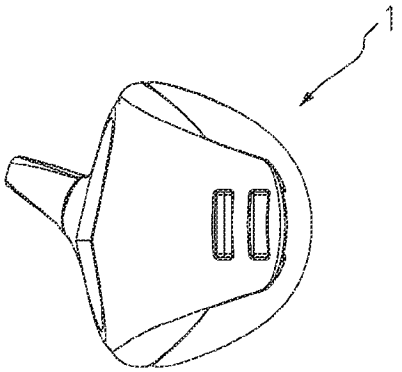
Figure 8D:
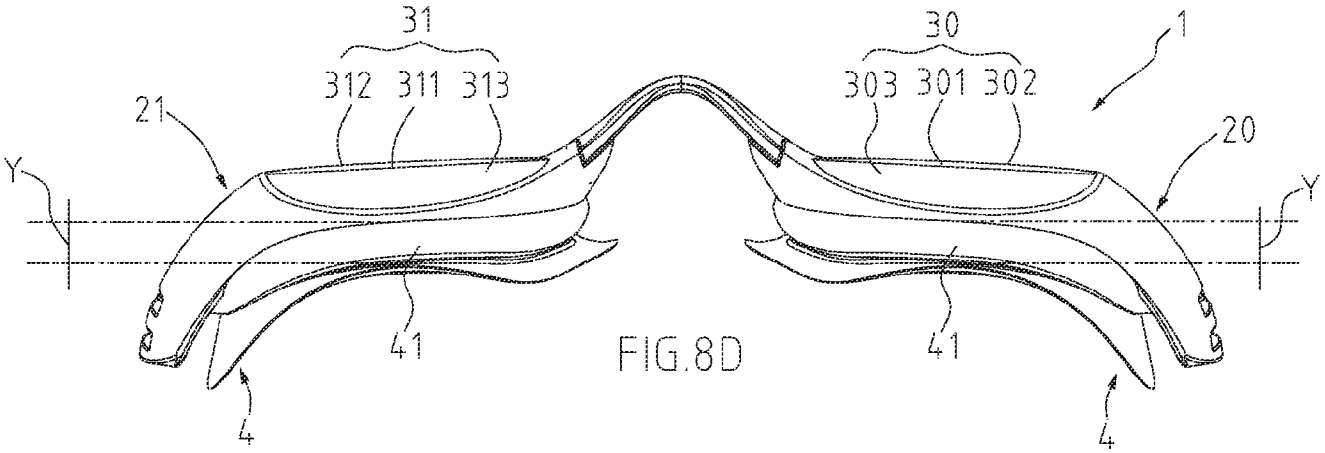

Particularly note that the swimming goggles 1 of the present invention as shown in FIGS. 1 to 7 and described above are for illustrating structures thereof When the swimming goggles 1 are in a state of being worn on the wearer, the positions of the swimming goggles 1 with respect to a wearer's face are different than that of the disclosure in FIGS. 1 to 7 as viewed from front, top, side and bottom angles. Referring to FIGS. 8A, 8B, 8C and 8D, positions of the first inclined faces 302 and 312 and the second inclined faces 303 and 313 of the lenses 30 and 31 are different than positions as described in the preceding paragraphs. It is because a thickness x at an upper edge of the connecting portion 41 of the protective pad 4 (as shown in FIG. 8A) is less than a thickness y at a lower edge of the connecting portion 41 (as shown in FIG. 8D). Furthermore, because the first inclined faces 302 and 312 are disposed above and incline inward from the fold lines 301 and 311, and the second inclined faces 303 and 313 are disposed below and incline inward from the fold lines 301 and 311, the upper edge of the connecting portion 41 is attached to the lower side of the eyebrow and is not beyond a forehead of the wearer as viewed from a side angle. Moreover, the first inclined faces 302 and 312 appear to be straight lines as viewed from a top angle (as shown in FIG. 8B). As viewed from a bottom angle, the lower edges of the connecting portion 41 are attached to the lower sides of the under-eye bags, and only the second inclined faces 303 and 313, the fold lines 301 and 311, and small portions of the first inclined faces 302 and 312 can be seen (as shown in FIG. 8D). Further referring to FIG. 8E for a practical position of the swimming goggles 1 being worn, the upper and lower edges of the connecting portion 41 of the protective pad 4 respectively have different thicknesses x and y so as to enable the left and right frame bodies 20 and 21 to be fit to the face portions. With the inclined configuration of the first inclined faces 302 and 312 and the second inclined faces 303 and 313, the swimming goggles 1 as a whole are not positioned beyond the forehead of the wearer after being worn, and the first inclined faces 302 and 312 of the lenses 30 and 31 are substantially parallel with the wearer's eyes.

Figure 8E:
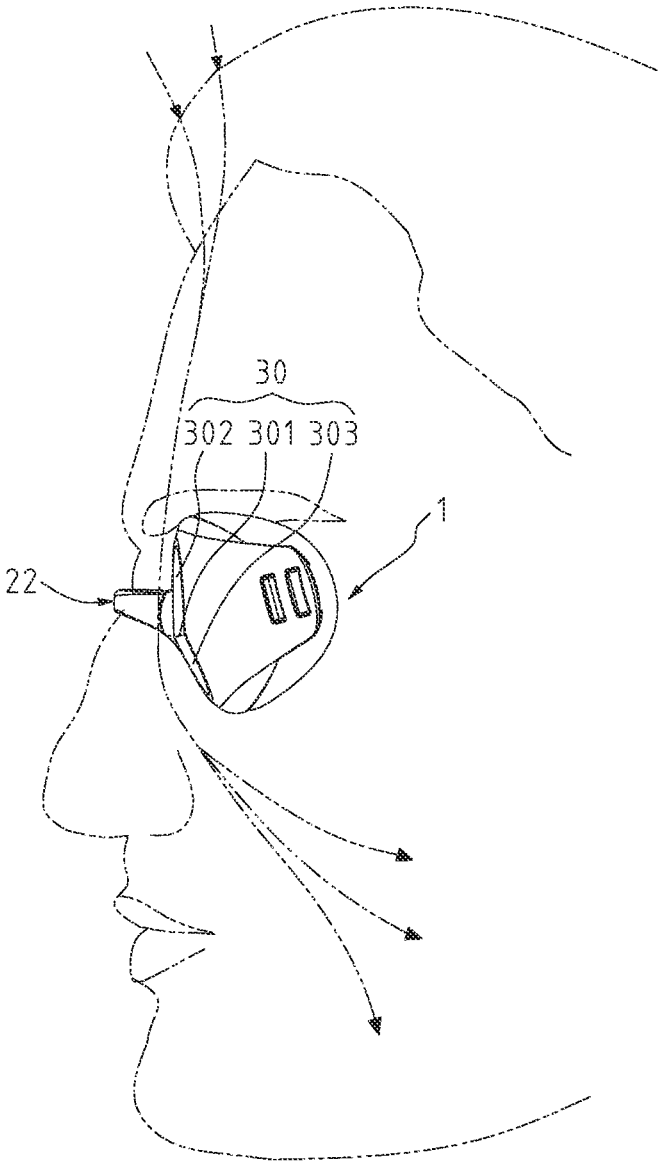

The head strap bases 5 are respectively disposed on outer sides of the left and right frame bodies 20 and 21. Each of the head strap bases 5 forms two through holes 50 and 51 each having a horizontal middle line that is positioned above the fold line 301 (311) of the lenses 30 (31) so as to allow a head strap (not shown) to be adjusted therethrough. Furthermore, each of the head strap bases 5 is oblique to the first inclined face 302 (312) so as to allow the first inclined face 302 (312) to remain a position being parallel with the eyes when the head strap is being drawn in wearing (as shown in FIG. 8E), whereby the swimming goggles 1 are capable of being positioned in place.

Figure 9:
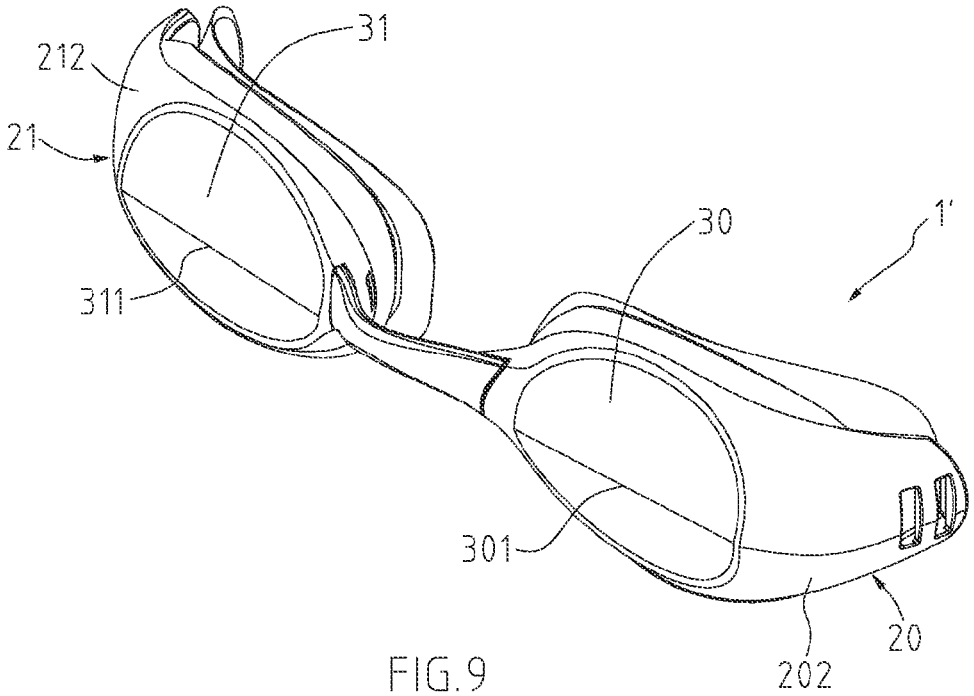
FIG. 9 is a perspective view showing fold lines extending to outer peripheral faces of left and right frame bodies in accordance with a second embodiment of the present invention.
Figure 10:
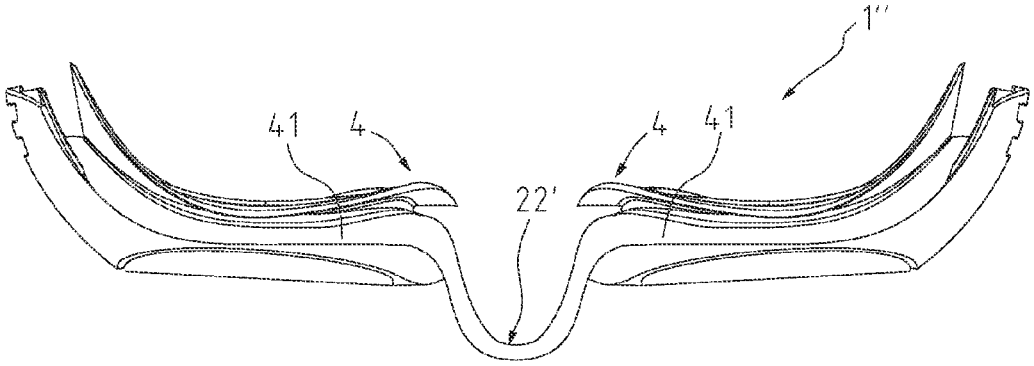
FIG. 10 is a top plan view showing a connecting element integrally formed with protective pads of the swimming goggles in accordance with a third embodiment of the present invention.
Figure 11:
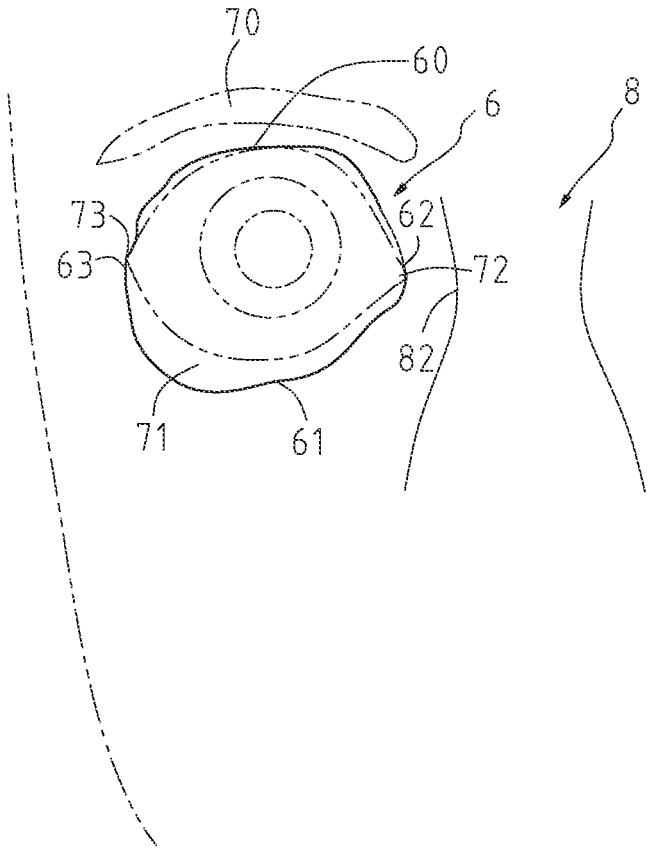
FIG.11 (Prior Art)
FIG. 11 is a schematic front elevational view partially showing a human's cranium and a shape of an eye socket.

Further referring to FIG. 9 illustrating a second embodiment of swimming goggles 1' of the present invention, major differences between the first and second embodiments are that the fold lines 301 and 311 respectively extend to the outer peripheral faces 202 and 212 of the left and right goggles 20 and 21. In this manner, after wearing, the first inclined faces 302 and 311 are substantially parallel with the eyes and therefore ensure that the range of visual filed is blocked by the left and right frame bodies, whereby providing a better view in swimming. Also, referring to FIG. 10 illustrating a third embodiment of swimming goggles 1", a connecting element 22' and the connecting portions 41 of the protective pads 4 are integrally formed together. That is, the connecting element 22' is also made of TPR and is formed with the protective pads 4 through double shot injection molding. The material of TPR is flexible and thus is fit for various profiles of noses. Particularly, in the third embodiment, concerning a combination of the left and right frame goggles 20 and 21 and the face contact portions 40, when the connecting portions 41 and the face contact portions 40 are made of a same material, the material of the connecting portions 41 is preferably harder than that of the face contact portions 40. When they are made of different materials, the connecting portions 41 are made of a composite material capable of combining the left and right frame bodies 20 and 21 with the face contact portions 40, and the connecting portions 41 and the face contact portions 40 of the protective pads 4 are made of different colors.

Accordingly, the contours of the outer peripheral faces of the left and right frame bodies 20 and 21 and the face contact portions 40 of the protective pads 4 are fit to the face portions with respect to inner peripheries of the eye sockets of the cranium, and the upper and lower edges of the face contact portions 40 with respect to the lower sides of the eyebrows and the lower sides of the under-eye bags remain the gap t with the connecting portions 41 where the face contact portions 40 are nearly in contact with the connecting portions 41. In this manner, the left and right frame bodies 20 and 21 are perfectly attached to the face portions with respect to inner peripheries of eye sockets of a cranium, and thus reduce the water resistance in swimming (directions of water flow shown as arrows in FIG. 8E). Additionally, the first inclined faces 302 and 312 and the second inclined faces 303 and 313 of the lenses 30 and 31 prevent the range of visual field from being blocked by the left and right frame bodies 20 and 21 and therefore provide a better view in swimming Furthermore, with the inclined configuration of the first inclined faces 302 and 312 and the second inclined faces 303 and 313, and different thickness of the first and second frame bodies 20 and 21 in vertical cross section, the first inclined faces 302 and 312 are substantially parallel with the wearer's eyes (referring to FIG. 8E). Still further, the face contact portions 40 of the protective pads 4 are in a continuous shape which enables an ergonomic contact with the face portions and ensure that the swimming goggles is being comfortably worn in place without water leakage.

It is understood that the invention may be embodied in other forms within the scope of the claims. Thus the present examples and embodiments are to be considered in all respects as illustrative, and not restrictive, of the invention defined by the claims.

What is claimed is:

1. Swimming goggles, comprising:

a left frame body and a right frame body, each of the left and right frame bodies having an inner peripheral face and an outer peripheral face;

lenses respectively integrally formed with the outer peripheral faces of the left and right frame bodies;

a connecting element interconnecting the left and right frame bodies;

protective pads respectively attached to the inner peripheral faces of the left and right frame bodies, each of the protective pads having a face contact portion and a connecting portion; and head strap bases respectively disposed on outer sides of the left and right frame bodies;

wherein contours of the outer peripheral faces of the left and right frame bodies and the face contact portions of the protective pads are fit to face portions with respect to inner peripheries of eye sockets of a cranium of a wearer, each of the face portions being defined to correspond to an upper inner periphery of the eye socket below an eyebrow, a lower side of an under-eye bag with respect to a lower inner periphery of the eye socket, a side portion of a nose bridge adjacent to lacrimal gland, and an outer eye corner with respect to an inner periphery of the eye socket adjacent to a temple, and wherein a hook channel extends from and along the inner peripheral face of each of the left and right frame bodies, the connecting portion of each protective pad integrally encompassing the hook channel, upper and lower edges of each of the face contact portions with respect to a lower side of the eyebrow and a lower side of the under-eye bag remaining a gap with the connecting portion in a manner that the upper and lower edges of the face contact portion are so nearly in contact with the connecting portion when not worn, as to come in contact with the connecting portion when worn; whereby the left and right frame bodies being capable of fitting onto the face portions with respect to the inner peripheries of the eye sockets of the cranium so as to be worn comfortably without water leakage and to reduce water resistance in swimming.

2. The swimming goggles of claim 1, wherein each of the lenses has a fold line to define the lens into a first inclined face and a second inclined face, the first inclined face is disposed above the fold line and inclines inward from the fold line, and the second inclined face is disposed below the fold line and inclines inward from the fold line.

3. The swimming goggles of claim 2, wherein the fold lines are horizontally formed on the lenses and positioned to correspond to lower sides of eyeballs of the wearer after being worn.

4. The swimming goggles of claim 3, wherein the fold lines of the lenses extend to the outer peripheral faces of the left and right frame bodies.

5. The swimming goggles of claim 1, wherein a thickness of each of the left and right frame bodies in vertical cross section adjacent to the eyebrow is less than a thickness of each of the left and right frame bodies adjacent to the lower side of the under-eye bag, whereby to enable each of the left and right frame bodies to be perfectly fit to contours of the lower side of the eyebrow and the lower side of the under-eye bag, and to enable the first inclined faces of the lenses to be substantially parallel with the eyes of the wearer.

6. The swimming goggles of claim 1, wherein the gap between the face contact portion and the connecting portion has a shape of V in vertical cross section such that the upper and lower edges of the face contact portion with respect to the lower side of the eyebrow and the lower side of the under-eye nearly contact the connecting portion.

7. The swimming goggles of claim 6, wherein each of the left and right frame bodies has an arc surface formed between the lacrimal gland and the side portion of the nose bridge so as to allow each of the left and right frame bodies to be perfectly attached to contours of the side portion of the nose bridge.

8. The swimming goggles of claim 7, wherein the gaps between the arc surfaces of the left and right frame bodies and the face contact portions enable the face contact portions to be bent towards the gaps so as to fit onto the contours of the side portions of the nose bridge.

9. The swimming goggles of claim 1, wherein the connecting element is being arc and is integrally formed with the connecting portions of the protective pads.

10. The swimming goggles of claim 1, wherein the connecting element is being arc and has engaging pegs at opposite ends thereof, the outer peripheral faces of the left and right frame bodies corresponding to the engaging pegs are extended to form engaging seats for being engaged with the engaging pegs, and the engaging seats are located above the fold lines of the lenses.

11. The swimming goggles of claim 2, wherein each of the head strap bases forms at least one through hole on the outer side of each of the left and right frame bodies, and the at least one through hole has a horizontal middle line that is positioned above the fold line.

12. The swimming goggles of claim 9, wherein the connecting portions and the face contact portions of the protective pads are capable of being made of a same material or a different material, and when the connecting portions and the face contact portions are made of the same material, a material of the connecting portions is harder than that of the face contact portions, or when the connecting portions and the face contact portions are made of different materials, the connecting portions are made of a composite material capable of combining the left and right frame bodies with the face contact portions.

13. The swimming goggles of claim 9, wherein the connecting portions and the face contact portions of the protective pads are made of different colors.

* * * * *